US005658208A

United States Patent [19]

Shimasaki

[11] Patent Number: 5,658,208

[45] Date of Patent: Aug. 19, 1997

[54] GOLF CLUB HEAD

[75] Inventor: Hirato Shimasaki, Tokyo, Japan

[73] Assignee: Bridgestone Sports Co., Ltd., Tokyo, Japan

[21] Appl. No.: 503,217

[22] Filed: Jul. 17, 1995

Related U.S. Application Data

[63] Continuation-in-part of Ser. No. 349,106, Dec. 2, 1994, abandoned.

[51] Int. Cl.[6] ..... A63B 53/04

[52] U.S. Cl. ..... 473/349; 473/350

[58] Field of Search ..... 273/167 H, 169, 273/167 F, 78, 171, 173, 167 J, 167 R, 172, 175, 167 A, 167 B, 167 E, 167 G, 167 K, 77 A; 473/290, 291, 334, 335, 341, 345

[56] References Cited

U.S. PATENT DOCUMENTS

| | | | |
|---|---|---|---|
| 2,846,228 | 8/1958 | Reach | 273/173 |
| 4,792,139 | 12/1988 | Nagasaki et al. | 273/173 |
| 4,848,747 | 7/1989 | Fujimura et al. | 273/173 |
| 4,928,972 | 5/1990 | Nakanishi et al. | 273/173 |
| 4,964,640 | 10/1990 | Nakanishi et al. | 273/173 |
| 4,992,302 | 2/1991 | Shira | 273/167 H |
| 5,082,278 | 1/1992 | Hsien | 273/173 |
| 5,290,036 | 3/1994 | Fenton et al. | 273/167 H |
| 5,297,794 | 3/1994 | Lu | 273/167 H |
| 5,348,302 | 9/1994 | Sasamoto et al. | 273/167 H |

FOREIGN PATENT DOCUMENTS 61-185282 8/1986 Japan .

*Primary Examiner*—Steven B. Wong
*Attorney, Agent, or Firm*—Jordan and Hamburg

[57] ABSTRACT

The golf club head according to the present invention comprises a head body having a cavity formed in a rear face thereof, striking face portion having a thickness less than that of a heel and toe portions, respectively, to improve the moment of inertia thereof, and a rear insert, which is made of a material of which the specific gravity is smaller than that of the material of the heel and toe portions, provided in the cavity of the head body, behind at least the sweet spot on the striking face.

4 Claims, 4 Drawing Sheets

GOLF CLUB HEAD

This application is a continuation-in-part, of application Ser. No. 08/349,106 filed Dec. 2, 1994 abandoned.

BACKGROUND OF THE INVENTION

The present invention relates to a golf club head, and more particularly to an improved iron-type golf club head with a cavity formed in its rear face (so-called "cavity-back" iron).

As shown in FIGS. 1 and 2, a conventional golf club head has a hosel 2 in which a club shaft 1 is inserted and fixed. The hosel 2 is formed integrally with a striking face portion 3, rear face 4, heel portion 5, toe portion 6 and a sole portion 7 of the club head. The rear face 4 has a cavity 41 formed therein. The heel portion 5 and toe portion 6 are formed thick while the striking face portion 3 is thin, for a higher moment of inertia. In the conventional club head, the cavity 41 is defined by an upper rib 8, lower rib 9, heel-side rib 10 and toe-side rib 11. Some of the conventional club heads with no such upper rib 8 or no such upper and lower ribs 8 and 9 have the cavity 41 formed in its rear face 4.

In the conventional so-called cavity-back type club head, the club head material which would otherwise exist in the place of the cavity 41 is distributed at the heel and toe portions. 5 and 6 to decrease the club head gyration when striking a ball at a point off from the center of the striking face 3 toward the toe portion 6 of the club head (so-called toe hit). To reduce gyration of the club head and increase the moment of inertia, it is effective to give an additional weight to the heel portion 5 and toe portion 6. However, the weight of the club head is limited and should not be limitlessly increased. Thus, when the club head weight is so increased, the striking face portion 3 thickness has to be reduced accordingly. Thus even when a ball is hit at a central area, namely, at the so-called sweet spot 30 on the striking face 3, a good feel from hitting is not obtained because the striking face portion 3 is so thin. Indeed, the traditional club head having no cavity 41 formed therein provides a good feel, but no reduction of head gyration on off-center hits is achieved.

SUMMARY OF THE INVENTION

Accordingly, the present invention has an object to overcome the above-mentioned drawbacks of the conventional golf club heads by providing a golf club head having a large moment of inertia and which provides a good feel when striking a golf ball. The "moment of inertia" referred to herein is such that when acted upon from outside, namely, when striking a golf ball, a moving object, namely, a club head, continues the same motion against the action thereupon. More particularly, a club head which will minimally open or rotate clockwise on a toe hit has a large moment of inertia and can strike a golf ball consistently along an intended line of flight.

The above object is attained by providing a golf club head comprising a head body having a cavity formed in a rear face thereof, a striking face portion which is thin and a heel and toe portions which are thick with respect to the striking face portion, respectively, to improve the moment of inertia thereof, and further a rear insert provided in the cavity having an inner surface and defining a rear of the head body opposite the striking face portion, behind at least the sweet spot on the striking face portion and which is made of a metal or metal alloy of which the specific gravity is smaller than that of the metal or metal alloy of the heel and toe portions.

The golf club head according to the present invention can strike a golf ball and provide a good feel without reduction in a large moment of inertia, an advantage of the so-called cavity-back type golf club heads. Since the rear insert is made of a material having a specific gravity smaller than that of the toe and heel portions and is provided in the cavity, behind the sweet spot on the striking face, the weight of the club head is positioned at the toe and heel portions and the moment of inertia of the club head is increased, thereby permitting to strike a golf ball with a good feel.

DETAILED DESCRIPTION OF THE PREFERRED EMBODIMENTS

The present invention will be further described with reference to the accompanying drawings.

Figure 1:
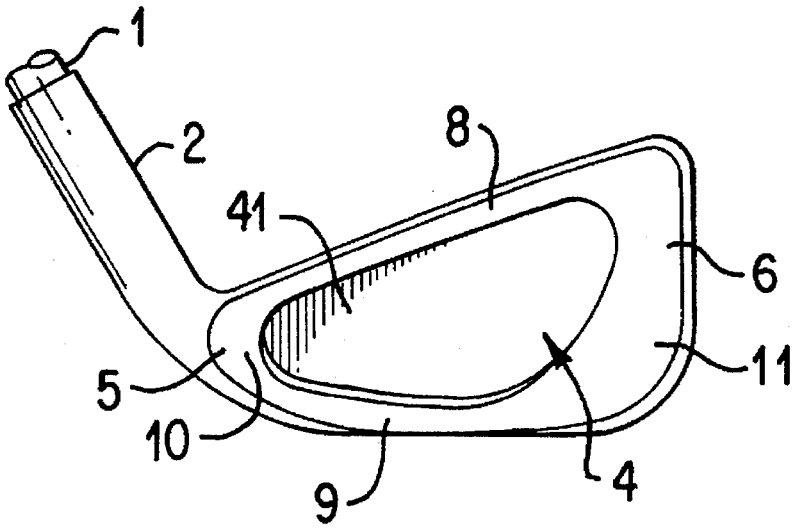
FIG. 1 (PRIOR ART)
FIG. 1 is a back view of a conventional golf club head.
Figure 2:
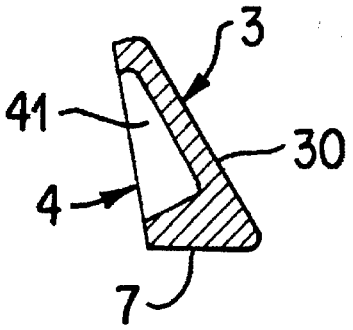
FIG. 2 (PRIOR ART)
FIG. 2 is a sectional view of a central portion of the golf club head.
Figure 3:
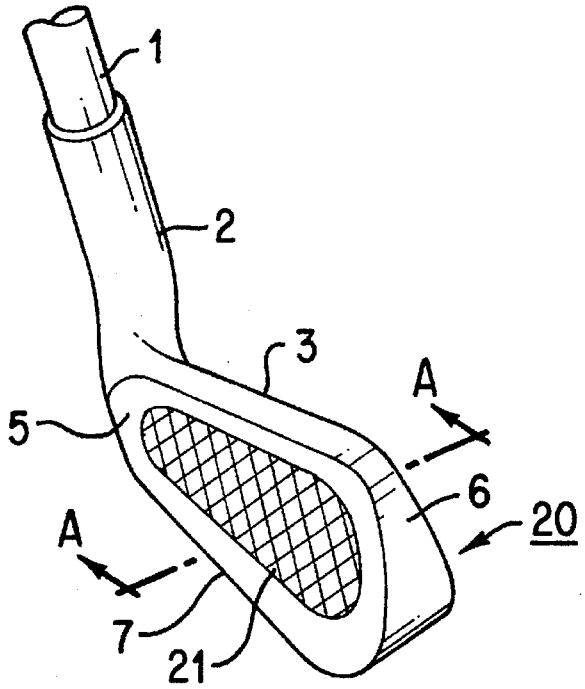
FIG. 3 is a view from the rear face of a first embodiment of the present invention.
Figure 4:
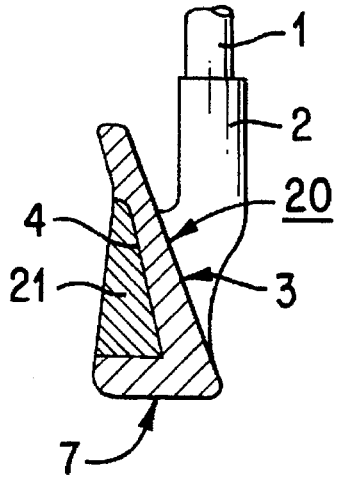
FIG. 4 is a sectional view taken along the line A—A in FIG. 3.

FIGS. 1 and 2 show together the first embodiment of the golf club head according to the present invention. In this embodiment, the club head has a hosel 2 having a club shaft 1 inserted and fixed therein. The hosel 2 is formed integrally with a striking face portion 3, a rear face 4, a heel portion 5, a toe portion 6 and a sole portion 7 to form a main body 20. To provide a higher moment of inertia of the club head body, the rear face 4 has a cavity 41 formed therein and the heel portion 5 and the toe portion 6 are formed thicker than the striking face portion 3. The striking face portion 3 is thin while the heel and toe portions 5 and 6 are thick with respect to the striking face portion 3. The body 20 is provided with a rear insert 21 to fill the cavity 41. The body 20 should preferably be made of a metal or an alloy thereof having a specific gravity of 4.5 to 9.0. The preferable metal or alloy for the body 20 may be selected from among a iron or an iron, stainless steel, titanium or titanium alloy, copper or copper alloy. The rear insert 21 should preferably be made of a metal or metal alloy whose specific gravity is 1 to 7, provided that the specific gravity of the rear insert 21 is smaller than that of the metal or metal alloy of the body 20. More preferably, the specific gravity of the rear insert 21 is 1.5 to 5.0. The difference in specific gravity is preferably 1.0 or more. More preferably, the specific gravity difference is 2.0–4.0. Preferable material for the rear insert 21 may be selected from among a titanium or its alloy, aluminum or its alloy, magnesium or its alloy, and beryllium or its alloys. The rear insert should preferably be made of a titanium or aluminum when the head body 20 is made of a soft iron or stainless steel. Where the rear insert 21 is to be buried in the entire cavity 41, the rear insert 21 should be formed separately from the head body 20 and press-fitted into the cavity 41. Of course, any other method of fitting can be adopted.

Preferably, the cavity-back type head body 20 is made of soft iron, and the rear insert 21 is made of titanium or its alloy. For such a configuration, the preferable thickness of the striking face portion 3 of the head body 20 is 2–5 mm, and more preferably, 3–4.5 mm. Moreover, the rear insert 21 made of titanium or its alloy is preferably thick enough to substantially fill the cavity a distance of 2–8 mm. Further, the weight of the rear insert 21 depends on the club number, but a preferable weight is 40–60 g in a No. 5 iron. The whole weight of head sums to 240–260 g in a No. 5 iron. Accordingly, the golf club head has a large moment of inertia which provides a superior feel when striking a golf ball to that of the prior art.

Figure 5:
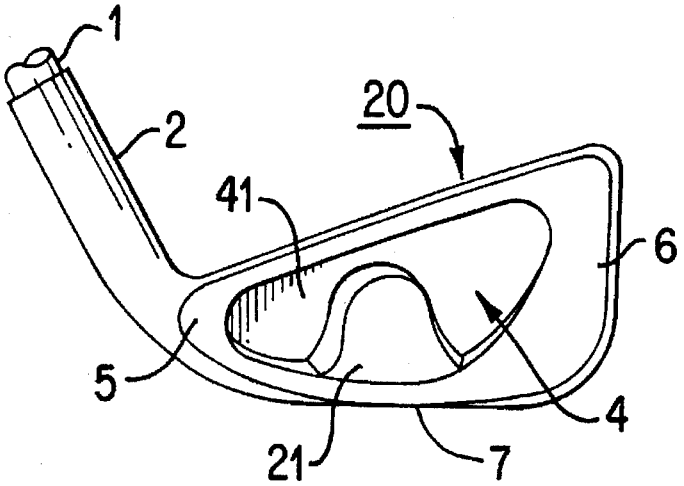
FIG. 5 is a partially fragmentary perspective view of another embodiment of the present invention.
Figure 6:
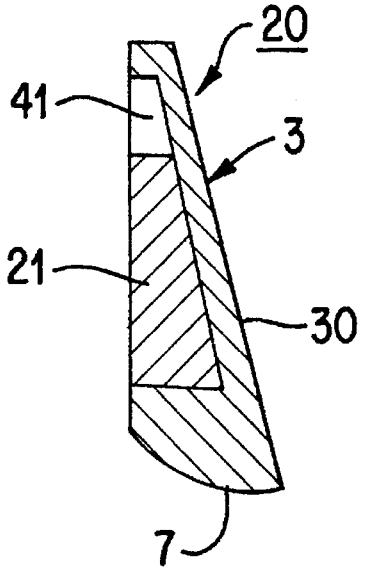
Figure 7:
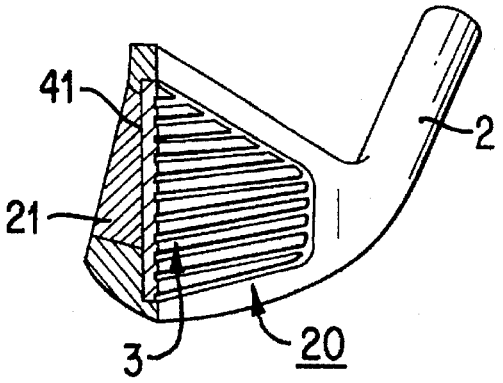
Figure 8:
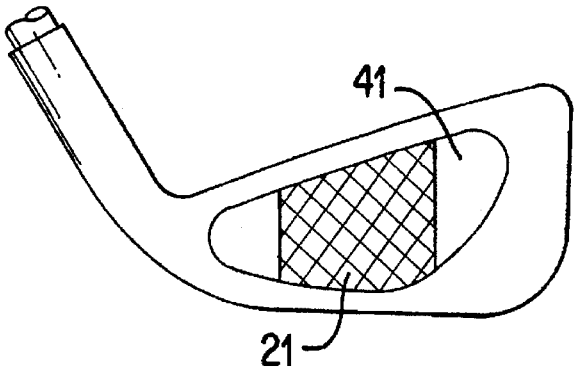
Figure 9:
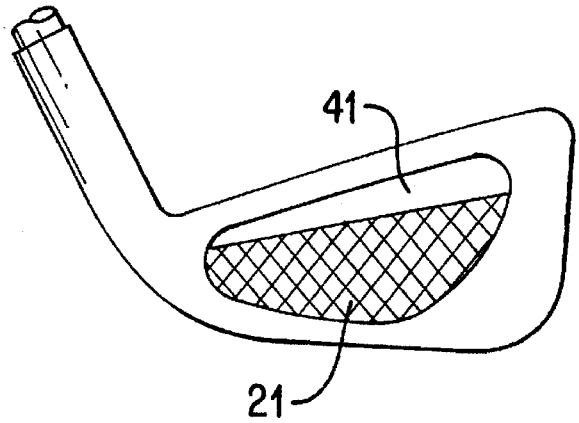

According to another embodiment shown in FIG. 5, every portion of the main body 20, except the striking face portion 3, is preferably made of a relatively heavier material such as a stainless steel, beryllium copper or the like while the striking face portion 3 is made of another material, for example, a titanium or its alloy. The striking face portion 3 can be press-fitted in place in the main body 20 (as in the so-called composite type). A rear insert 21 is provided behind in the cavity 41 formed behind the striking face 3.

What is claimed is:

1. A golf club head comprising:

a head body having a striking face portion, a rear face defining a cavity formed therein and behind said striking face portion, and heel and toe portions having thicknesses greater than said striking face portion;

said striking face portion having a thickness in the range of 2 to 5 mm;

said head body being formed of one of a metal and a metal alloy selected from the group consisting of iron, iron alloy, stainless steel, copper, and copper alloy, having a specific gravity of 7.0 to 9.0;

a rear insert press-fitted in said cavity to fill said cavity and define a rear face of said head body opposite said striking face portion;

said rear insert being formed from one of a metal and a metal alloy selected from the group consisting of titanium, titanium alloy, aluminum, aluminum alloy, magnesium, and magnesium alloy, having a specific gravity of 1.5 to 5.0 and having a thickness of 2 to 8 mm; and said head body having a specific gravity which is greater than that of said rear insert by an amount in the range of 2.0 to 4.0 times.

2. A golf club head as set forth in claim 1, wherein said rear insert has a weight in the range of 40 to 60 g.

3. A golf club head as set forth in claim 1, wherein the head body is made of soft iron and the rear insert is made of titanium or its alloy.

4. A golf club head, comprising:

a head body having a striking face portion made of one of titanium and a titanium alloy and having a thickness of 2 to 5 mm, a rear portion having a cavity formed therein and behind said striking face portion, and heel and toe portions thicker than said striking face portion;

a rear insert press-fitted in said cavity to fill said cavity and define a rear face of said head body opposite to said striking face portion;

said head body, except for said striking face portion, being made of one selected from a group consisting of iron, iron alloy, stainless steel, copper, and copper alloy, and that has a specific gravity of 7.0 to 9.0;

said rear insert being made of one selected from a group consisting of titanium, titanium alloy, aluminum, aluminum alloy, magnesium, and magnesium alloy, and said rear insert having a thickness of 2 to 8 mm and a specific gravity of 1.5 to 5.0; and the specific gravity of said head body being 2.0 to 4.0 times greater than that of said rear insert.

* * * * *